United States Patent [19]

Williamson

[11] Patent Number: 4,947,562

[45] Date of Patent: Aug. 14, 1990

[54] SELF-LOADING SNOW REMOVAL TOOL

[76] Inventor: James W. Williamson, P.O. Box 93, Tahoe City, Calif. 95730

[21] Appl. No.: 301,425

[22] Filed: Jan. 25, 1989

[51] Int. Cl.[5] ..... E01H 5/00

[52] U.S. Cl. ..... 37/197; 15/236.02; 15/236.05; 37/265; 37/285; 294/54.5

[58] Field of Search ..... 15/236.01, 236.02, 236.05, 15/197; 37/265, 278, 284, 285; 294/54.5

[56] References Cited

U.S. PATENT DOCUMENTS

| | | | |
|---|---|---|---|
| 1,319,912 | 10/1919 | Round . | |
| 1,810,026 | 6/1931 | Moller . | |
| 2,347,963 | 5/1944 | O'Neill | 37/285 X |
| 2,639,454 | 5/1953 | Dory . | |
| 2,699,614 | 1/1955 | Welch | 15/236.01 X |
| 3,091,790 | 6/1963 | Schroeder | 37/285 X |
| 3,383,747 | 6/1971 | Lambert | 37/285 X |
| 3,473,838 | 10/1969 | Rankin . | |
| 3,773,375 | 11/1973 | Nehls . | |
| 4,264,095 | 4/1981 | Lemasters . | |
| 4,550,943 | 11/1985 | Mirto | 294/54.5 |
| 4,848,819 | 7/1989 | Moorefield | 294/54.5 |

FOREIGN PATENT DOCUMENTS

| | | | |
|---|---|---|---|
| 874445 | 4/1953 | Fed. Rep. of Germany | 294/54.5 |
| 94681 | 2/1939 | Sweden . | |
| 74249 | 2/1917 | Switzerland | 15/236.05 |
| 1387561 | 3/1975 | United Kingdom | 37/284 |

*Primary Examiner*—Chris K. Moore

*Attorney, Agent, or Firm*—Townsend and Townsend

[57] ABSTRACT

A self-loading tool 2 for removing snow 10 from a surface 12 includes a blade 4 attached to a handle 6. Handle 6 is attached to a neutral plane 24 of blade 4 at an angle between about 65° to about 85° and preferably about 75°. This angle of attachment between handle and blade permits the blade to be self-loading when pushing or when pulling snow across a surface. An apparatus and a method are disclosed.

11 Claims, 1 Drawing Sheet

SELF-LOADING SNOW REMOVAL TOOL

BACKGROUND OF THE INVENTION

This invention relates generally to tools from removing snow, and more particularly to hand operated tools for removing snow from the surface of a motor vehicle and the like.

Removing snow can be exhausting. Generally many known snow removal tools require the user to push the snow away, while other known tools require the user to pull the snow toward the user. Depending on the type of tool being used, after each pushing or pulling the user must relocate himself or herself to continue the snow removal operation. Further, the constant pushing or constant pulling action is strenuous to the user.

SUMMARY OF THE INVENTION

The invention is a snow removal tool that is self-loading and enables a user to remove snow from a surface using both a pushing motion and pulling motion. The invention includes a blade, and a handle attached to the blade for holding the tool. The blade includes first and second faces and first and second spaced apart edges. The handle is attached to the first face of the blade at an angle of about 65° to 85° with respect to a neutral plane defined by the blade.

Applicant has discovered that a 65° to 85° angle of attachment between the handle and the blade permits the blade to be self-loading, regardless of whether the blade is used to push or pull snow. When used to push snow, the second edge of the blade is placed opposite the surface from which the snow is to be removed and the second blade face is used to push the snow. The oblique angle formed between the surface from which the snow is being removed and the plane of the blade causes the removed snow to pile up against the second blade face, as the blade is pushed and to force the second edge downwardly toward the surface. The tool is also self-loading when used to remove snow by pulling. The first blade edge is placed against the surface from which the snow is to be removed and the blade is pulled with the handle. The first blade face contacts the snow, and the oblique angle formed between the surface and the plane of the blade causes the removed snow to pile up against the first face, as the blade is pulled, and to force the first edge downwardly toward the surface.

The present invention advantageously provides a tool for removing snow from a surface using a pushing motion, a pulling motion, or both motions. The invention advantageously allows a user to push snow from a surface, twist the handle and then pull the snow from a surface, without requiring the user to reposition himself or herself after each stroke. Since snow removal can be done from one side of the vehicle using the present invention, the user can stay on the curb side of the vehicle - a significant safety feature. Further, because pushing and pulling strokes may be alternated, muscle strain is diminished. The invention can also be used to pull snow away from the wheels of a vehicle when stuck or when chains are mounted onto or removed from the vehicle wheels.

Other aspects features and advantages of the invention will appear from the following description wherein the preferred embodiment has been set forth in detail in conjunction with the accompanying drawings.

DETAILED DESCRIPTION OF THE PREFERRED EMBODIMENT

Figure 1:
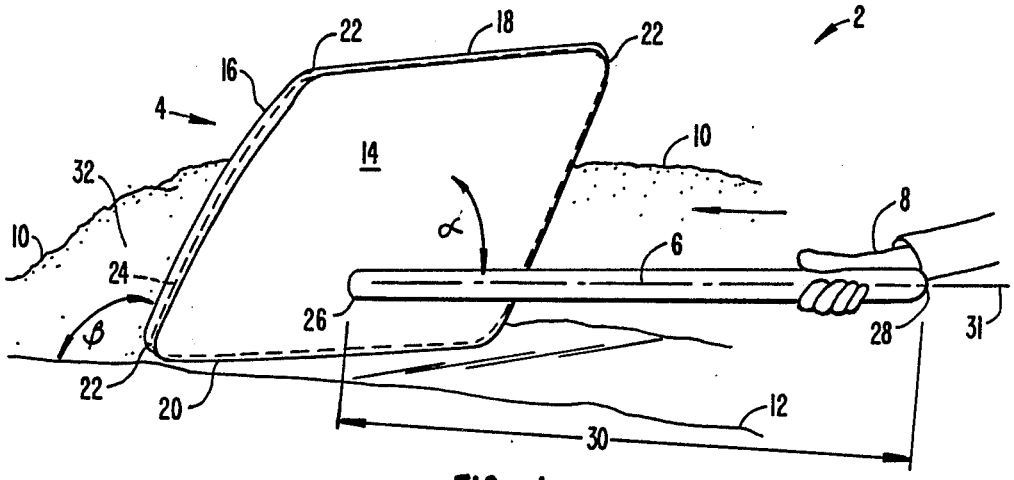
FIG. 1 is a perspective view of a snow removal tool according to the present invention removing snow with a pushing motion.

FIG. 1 shows the present invention 2 as including a blade 4 attached to a handle 6 held by a user 8 to remove snow 10 from a surface 12. Blade 4 has first and second spaced-apart faces 14 and 16, and first and second-spaced apart edges 18 and 20. Edges 18 and 20 have a slightly rounded profile 22 to help prevent scratching of the vehicle surface. Other profiles such as flat may also be used on either or both edges. Corners 23 are also rounded to help prevent scratching of the vehicle surface and catching on chrome strips and the like. Blade 4 defines a neutral blade plane 24 which passes generally through the center of blade 4.

Handle 6 includes a first end 26, a second end 28 and a length 30 therebetween defining a longitudinal handle axis 31. The first handle end 26 is attached to the first face 14, forming an angle $\alpha$ of about 65° to about 85° between the axis 31 and the neutral plane 24. Handle 6 is preferably attached to first face 14 generally towards the second edge 20, with the angle $\alpha$ being approximately 75°. Other attachment locations may be used as well; for example, handle 6 could be attached to the center of face 14 at the angle $\alpha$.

Figure 3:
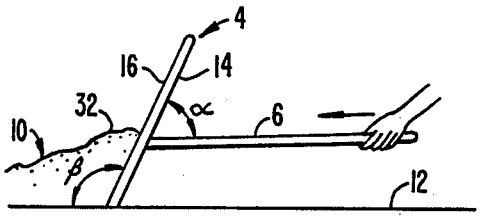
FIG. 3 is a left side view of a snow removal tool according to the present invention when used for pushing snow.

With reference to FIG. 3, the handle 16 is shown as forming an angle $\alpha$ with respect to the neutral plane 24. Applicant has discovered that if the angle $\alpha$ is between about 65° and about 85°, an obtuse angle $\beta$ results between the face of blade 4 contacting snow 10, and the snow covered surface 12. The resultant obtuse angle $\beta$ is such that the weight of the loaded snow 32 against the second face 16 when the tool 2 is pushed (as shown by the arrow in FIG. 3) forces second edge 20 to remain opposite or in contact with surface 12. When the tool 26 is pulled (as shown by the arrow in FIG. 4) the resultant obtuse angle $\beta$ is such that the weight of the loaded snow 32 pushes against the first face 14 thereby pushing first edge 18 towards or in contact with surface 12. In this manner the tool 2 is self-loading in the sense that the weight of the snow 10 being removed from surface 12 forces the edge 18 or 20 of the blade 4 towards the surface 12. In the preferred embodiment the angle $\alpha$ is about 75°.

Figure 2:
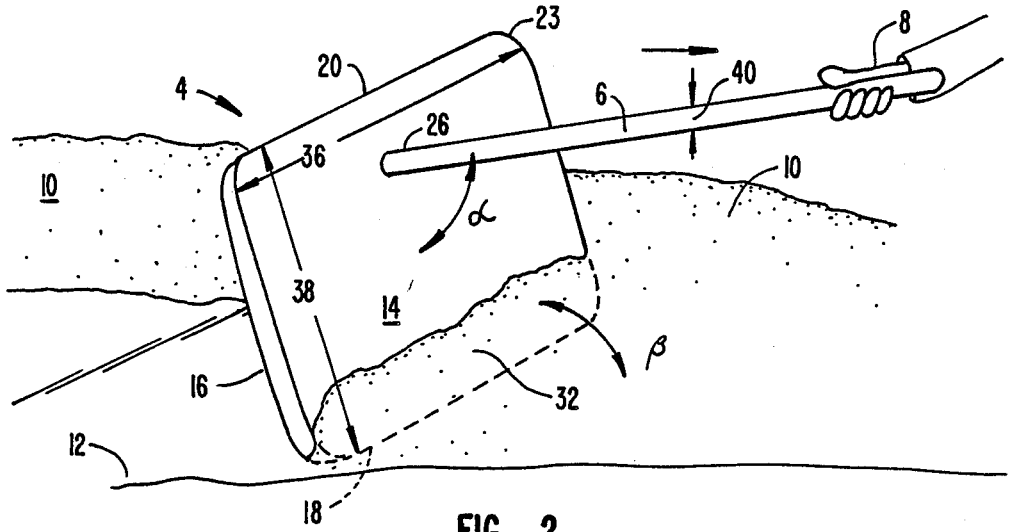
FIG. 2 is a perspective view of the tool shown in FIG. 1, removing snow with a pulling motion.

While FIGS. 1 and 2 show a blade 4 having substantially flat first and second faces 14 and 16, faces 14 and 16 could be other than flat so long as the self-loading aspect of the blade is maintained.

Figure 4:
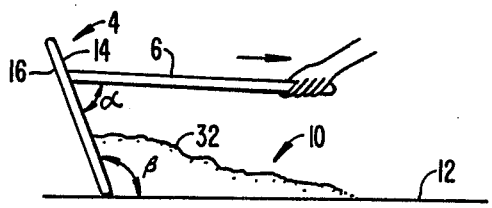
FIG. 4 is a left profile view of a snow removal tool according to the present invention when used to remove snow by pulling.

In operation, the user 8 places first edge 18 opposite surface 12 and removes snow 10 by pulling blade 4 using handle 6, as shown in FIG. 4. The user may then rotate handle 6 180° and place edge 20 opposite surface 12 and push snow with face 16 as shown in FIG. 3. The user may then push or pull tool 2, as desired, to remove snow 10 from surface 12 without the necessity of the user changing position after each stroke. In fact, the push-pull operation permits snow to be removed from a substantial portion of a motor vehicle while the user's feet remain in one position.

The present invention may be constructed out of metal, plastic wood or other material. Preferably blade 10 is made of a plastic formulated to withstand cold temperatures and be somewhat flexible, and have the ability to keep snow from sticking to it. In a preferred embodiment suitable for removing snow from the surface of a motor vehicle, blade 10 has a length 36 of about 10" (25 cm) and a height 38 of about 8" (20 cm). Handle 6 is cylindrical with a transverse dimension 40 of about 1¼ (3.2 cm) and is attached at angle $\alpha=75°$ approximately 25% of the distance up from edge 20. Handle 6 may be contoured to provide a secure grip even when the user is wearing gloves. Handle 6 may be of a variety of lengths, and could be telescoping as well. It is to be understood of course that other dimensions and other configurations for the blade and the handle may be selected, and that the handle may be disposed at other locations on the first face 14. The invention can also be used to remove snow from a boat; it is very useful for this since it is often not possible to get on the boat to remove the snow. Other modifications and variations may be made to the disclosed embodiment without departing from the scope of the invention as defined by the following claims.

What is claimed is:

1. A hand operated self-loading tool for removing snow from a surface by pushing and pulling the tool, comprising:

a blade including first and second faces, and first and second spaced apart edges, each edge defining a substantially rounded cross-section, the blade defining a neutral plane;

a handle attached to the first face, at an angle of about 65° to about 85° with respect to the neutral plane;

the handle permitting a suer to push or pull the blade to remove snow from the surface, the second face pushing the snow when the second edge is opposite the surface, the first face pulling the snow when the first edge is opposite the surface;

said angle between the handle and the blade causing the snow being removed to press against the second face and maintain the second edge of the blade opposite the surface while pushing the tool when the handle is substantially parallel to the surface, and said angle causing the snow being removed to press against the first face and maintain the first edge of the blade opposite the surface while pulling the tool when the handle is substantially parallel to the surface.

2. The hand operated tool of claim 1, wherein the blade is substantially flat.

3. The hand operated tool of claim 1, wherein said angle is about 75°.

4. The hand operated tool of claim 1, wherein the handle is attached to the first face towards the second edge.

5. The hand operated tool of claim 1, wherein the first and second edges substantially conform to the surface from which snow is to be removed.

6. The hand operated tool of claim 1, wherein the handle is elongated.

7. A hand operated self-loading tool for removing snow from a surface by pushing and pulling the tool, comprising:

a blade including first and second faces, and first and second spaced apart edges, each edge defining a substantially rounded cross-section, the blade sized top remove snow and defining a neutral plane;

an elongated handle attached to the first face towards the second edge, at an angle of about 75° with respect to the neutral plane;

the handle permitting a user to push or pull the blade to remove snow from the surface, the second face pushing the snow when the second edge is opposite the surface, the first face pulling he snow when the first edge is opposite the surface;

said angle between the handle and the blade causing the snow being removed to press against the second face and maintain the second edge of the blade opposite the surface while pushing the tool when the handle is substantially parallel to the surface, and said angle causing the snow being removed to press against the first face and maintain the first edge of the blade opposite the surface while pulling the tool when the handle is substantially parallel to the surface.

8. A method of removing snow from a surface with a self-loading hand operated tool, comprising the following steps:

selecting a tool with a blade and a handle, the blade sized to remove snow and defining a neutral blade plane, the blade including first and second faces and first and second spaced apart edges, the handle attached to the first face of the blade at an angle of about 65° to about 85° with respect to the neutral blade plane;

resting the second edge on the surface and then pushing the second face into the snow to push the snow over the surface;

resting the fist edge on the surface and then pulling the first face toward the snow to pull the snow over the surface;

said angle between the handle and the blade causing the snow being removed to press against the second face and maintain the second edge in contact with the surface while pushing the tool when the handle is substantially parallel to the surface, and said angle causing the snow being removed to press against the first face and maintain the first edge in contact with the surface while pulling the tool when the handle is substantially parallel to the surface.

9. The method of claim 8, wherein the step of selecting a tool includes selecting a blade whose first and second edges substantially conform to the surface from which snow is to be removed.

10. The method of claim 8, wherein the step of selecting a tool includes selecting a blade with first and second edges each defining a substantially rounded cross-section.

11. The method of claim 8, wherein the step of selecting is carried out using a handle attached to the blade at an angle of about 75°.

* * * * *